US011304453B2

(12) United States Patent
Qiu

(10) Patent No.: US 11,304,453 B2
(45) Date of Patent: Apr. 19, 2022

(54) ATOMIZER AND ELECTRONIC CIGARETTE HAVING THE SAME

(71) Applicant: CHANGZHOU PATENT ELECTRONIC TECHNOLOGY CO., LTD, Jiangsu (CN)

(72) Inventor: Weihua Qiu, Jiangsu (CN)

(73) Assignee: CHANGZHOU PATENT ELECTRONIC TECHNOLOGY CO., LTD, Jiangsu (CN)

( * ) Notice: Subject to any disclaimer, the term of this patent is extended or adjusted under 35 U.S.C. 154(b) by 273 days.

(21) Appl. No.: 16/712,766

(22) Filed: Dec. 12, 2019

(65) Prior Publication Data

US 2020/0113236 A1 Apr. 16, 2020

Related U.S. Application Data

(63) Continuation-in-part of application No. PCT/CN2018/087608, filed on May 21, 2018.

(30) Foreign Application Priority Data

Jun. 12, 2017 (CN) ..... 201720679809.0
Jun. 12, 2017 (CN) ..... 201720692045.9

(51) Int. Cl.

| | |
|---|---|
| ***A24F 13/00*** | (2006.01) |
| ***A24F 40/49*** | (2020.01) |
| *A24F 15/015* | (2020.01) |
| *A24F 40/10* | (2020.01) |
| *A24F 40/485* | (2020.01) |

(52) U.S. Cl.
CPC ..... *A24F 40/49* (2020.01); *A24F 15/015* (2020.01); *A24F 40/10* (2020.01); *A24F 40/485* (2020.01)

(58) Field of Classification Search
CPC ..... A24F 47/00
USPC ..... 131/328–329
See application file for complete search history.

(56) References Cited

U.S. PATENT DOCUMENTS 10,015,992 B2 * 7/2018 Li ..... A24F 40/485

FOREIGN PATENT DOCUMENTS

| | | |
|---|---|---|
| CN | 204146325 U | 2/2015 |
| CN | 204812051 U | 12/2015 |
| CN | 204949516 U | 1/2016 |
| CN | 205284996 U | 6/2016 |
| CN | 207125316 U | 3/2018 |
| CN | 207322682 U | 5/2018 |

* cited by examiner

*Primary Examiner* — Phuong K Dinh
(74) *Attorney, Agent, or Firm* — Novick, Kim & Lee, PLLC; Allen Xue

(57) ABSTRACT

An atomizer for an electronic cigarette includes an upper cover assembly, a base assembly, and an atomizer head. The upper cover assembly includes an inner lining member defining a positioning hole and a first sliding groove, the first sliding groove includes a translational groove and a rotation groove in communication with the translational groove, the position hole is parallel to the translational groove, and a connecting member defines a first liquid intake hole in communication with the liquid storage chamber. The atomizer requires a translational push is needed prior to opening the liquid intake hole by a side sliding so as to improve safety.

20 Claims, 13 Drawing Sheets

ATOMIZER AND ELECTRONIC CIGARETTE HAVING THE SAME

FIELD OF THE TECHNOLOGY

The disclosure relates to a technical field of smoke simulation, and more particularly, relates to an atomizer and an electronic cigarette of the atomizer.

BACKGROUND

In the current market of electronic cigarette, the liquid intake modes of most atomizers are bottom liquid injection, side surface liquid injection or top liquid injection way. At the early time, most of the atomizers adopt a bottom liquid injection, due to the inconvenience of the bottom liquid injection and the sealing effect of the bottom liquid injection is poor, nowadays, most of the atomizers adopt the top liquid injection and side surface injection, however, in the two ways, the top of the atomizer should be opened or rotated to a designated position, and the liquid injection is performed. After the liquid injection is finished, the top of an atomizer should be returned to the original position. Compared to the early bottom liquid injection, it is more convenient and clean for the top liquid injection or the side liquid injection. However, the operation is not very convenient, the frequent performance reduces user's experience about the product.

On another aspect, in the present liquid injection mode, the children protection function is ignored. Children can open the atomizer and contact the tobacco liquid easily, there is a safety hazard.

SUMMARY

Accordingly, it is necessary to provide an atomizer and an electronic cigarette having the atomizer to overcome at least one of aforementioned technical shortcomings.

The technical solution adopted by the disclosure to solve technical problems is that: an atomizer having a liquid storage chamber, includes an upper cover assembly, a base assembly, and an atomizer head. The upper cover assembly includes an inner lining member defining a positioning hole and a first sliding groove, the first sliding groove includes a translational groove and a rotation groove in communication with the translational groove, the position hole is parallel to the translational groove, and a connecting member defines a first liquid intake hole in communication with the liquid storage chamber, the connecting member is provided with a rotatable shaft mounted in the positioning hole and a limiting shaft mounted in the first limiting groove. Wherein the inner lining member or the connecting member is pushed until the limiting shaft reaches the rotation groove from the translational groove, the inner lining member and the connecting member rotate around the rotatable shaft, the limiting shaft slides along the rotation groove to reveal the first liquid intake hole.

It is obvious that: in the atomizer of the disclosure, a translational push performance is added prior to open the liquid intake hole by a side sliding, the children cannot open the liquid intake hole easily, and security is improved.

Further, the positioning hole is a kidney-shaped hole, the first sliding groove is a "L" shape groove.

Further, the connecting member defines a latching groove, the inner lining member is provided with a latching clip corresponding to the latching groove, or, the connecting member is provided with a latching clip, the inner lining member defines a latching groove corresponding to the latching clip, the latching clip is latched with the latching groove to enable the inner lining member to remain a closed state relative to the connecting member.

Further, the connecting member is provided with a sealing member therein, the sealing member defines a second liquid intake hole corresponding to the first liquid intake hole.

Further, the connecting member defines a sealing groove, the sealing member is hermetically positioned in the sealing groove.

Further, the connecting member is provided with an elastic member, an end of the elastic member is fixed to the connecting member, an opposite end of the elastic member is provided with a limiting member, the inner lining member defines a matching groove corresponding to the limiting member.

Further, the number of the matching groove is two, the positions of the two matching grooves are respectively corresponding to the positions of the limiting member when the first liquid intake hole is opened or closed.

Further, the connecting member defines an assembly hole, the elastic member is positioned in the assembly hole, a part of the limiting member is revealed in the assembly hole.

An electronic cigarette, includes any one of aforementioned atomizer.

According to another aspect of the disclosure, an atomizer is provided. The atomizer has a liquid storage chamber and includes: an upper cover assembly, a base assembly, and an atomizer head. The upper cover assembly includes an inner lining member defining a first sliding groove. The connecting member defines a first liquid intake hole in communication with the liquid storage chamber, the connecting member being provided with a rotatable shaft and a limiting shaft, wherein the upper cover assembly and the base assembly are respectively mounted on opposite ends of the atomizer head, the limiting shaft extends through the first sliding groove, the inner lining member is rotatably connected to the rotatable shaft, when the inner lining member rotates relative to the connecting member, the limiting shaft slides in the first sliding groove, to open or close the first liquid intake hole.

It is obvious that: in the atomizer of the disclosure, a translational push performance is added prior to open the liquid intake hole by a side sliding, the children cannot open the liquid intake hole easily, and security is improved.

Further, the connecting member defines a latching groove, the inner lining member is provided with a latching clip corresponding to the latching groove, or, the connecting member is provided with a latching clip, the inner lining member defines a latching groove corresponding to the latching clip, the latching clip is latched with the latching groove to enable the inner lining member to remain a closed state relative to the connecting member.

Further, the connecting member is provided with a sealing member therein, the sealing member defines a second liquid intake hole corresponding to the first liquid intake hole.

Further, the connecting member is provided with a receiving portion, the sealing member is positioned in the receiving portion.

Further, the connecting member is provided with an elastic member, an end of the elastic member is fixed to the connecting member, an opposite end of the elastic member is provided with a limiting member, the inner lining member defines a matching groove corresponding to the limiting member.

Further, the elastic member is a spring, the connecting member defines an assembly hole, the limiting member is a roll ball, the elastic member is positioned in the assembly hole, a part of the limiting member is revealed in the assembly hole.

Further, the upper cover assembly further comprises an upper cover positions on the inner lining member and wrapped around the inner lining member.

An electronic cigarette, includes any one of aforementioned atomizer.

BRIEF DESCRIPTION OF THE DRAWINGS

The disclosure is specifically illustrated with reference to accompanying drawings and embodiments in the following description.

Figure 1:
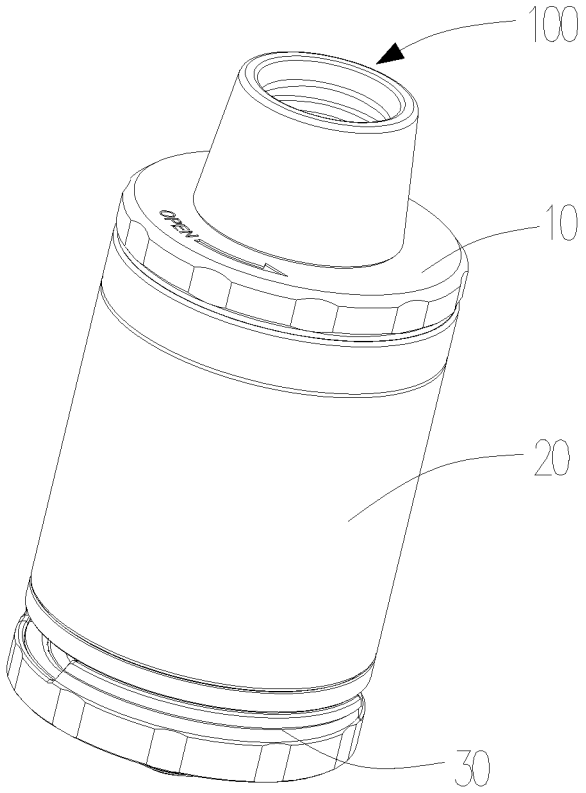
FIG. 1 is a schematic view of an atomizer according to a first embodiment.

Designations and reference numerals of the part and component in the accompanying drawings.

| | | |
|---|---|---|
| atomizer 100 | upper cover assembly 10 | month piece 11 |
| upper cover 12 | inner lining member 13 | positioning hole 131 |
| first sliding groove 132 | translational groove 1321 | rotation groove 1322 |
| latching clip 133 | matching groove 134 | sealing member 14 |
| second liquid intake hole 141 | second sliding groove 142 | connecting member 15 |
| sealing groove 151 | first liquid intake hole 152 | latching groove 153 |
| assembly hole 154 | threaded hole 155 | rotatable shaft 16 |
| limiting shaft 17 | elastic member 18 | limiting member 19 |
| sleeve 20 | base assembly 30 | liquid storage chamber 40 |
| atomizer head | | |

DETAILED DESCRIPTION OF THE PREFERRED EMBODIMENT

The disclosure is specifically illustrated with reference to accompanying drawings. The accompanying drawings are schematic views which simplified shows fundamental structures of an exemplary embodiment of the disclosure. Thus, merely the constructions related to the disclosure are shown.

The First Embodiment

Figure 2:
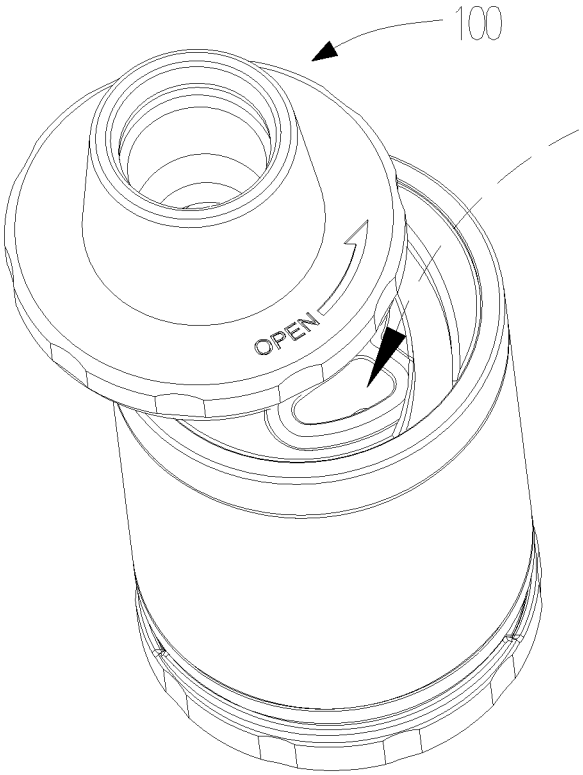
FIG. 2 is a schematic view of an atomizer according to a first embodiment when in a liquid injection state.
Figure 15:
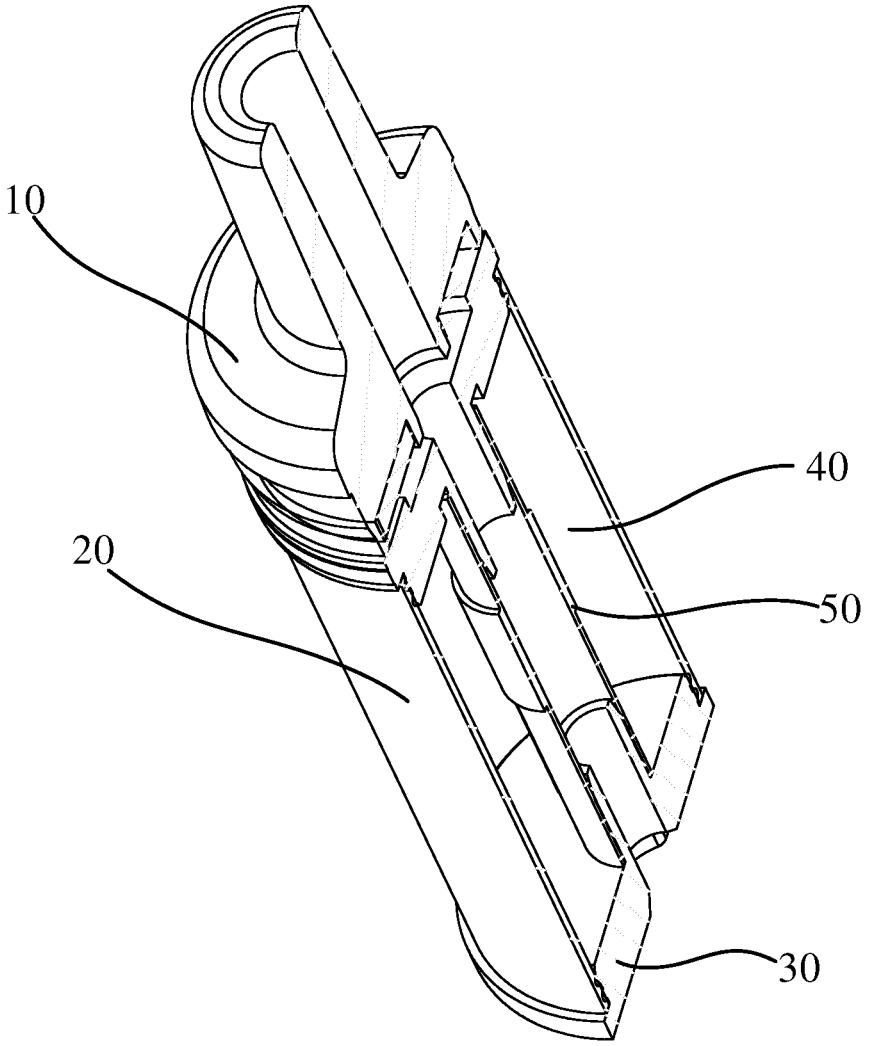
FIG. 15 shows a cross section of the atomizer of FIG. 1.

As shown in FIGS. 1, 2, and 15, the disclosure provides an electronic cigarette (not shown). The electronic cigarette includes an atomizer 100 and a battery assembly (not shown) electrically connected to the atomizer 100. The atomizer 100 includes an upper cover assembly 10, a base assembly 30, an atomizer head 50, and a sleeve 20, the upper cover assembly 10 and the base assembly 30 are respectively assembled to opposite ends of the atomizer head 50, the sleeve 20 is sleeved outside the atomizer head 50.

Figure 3:
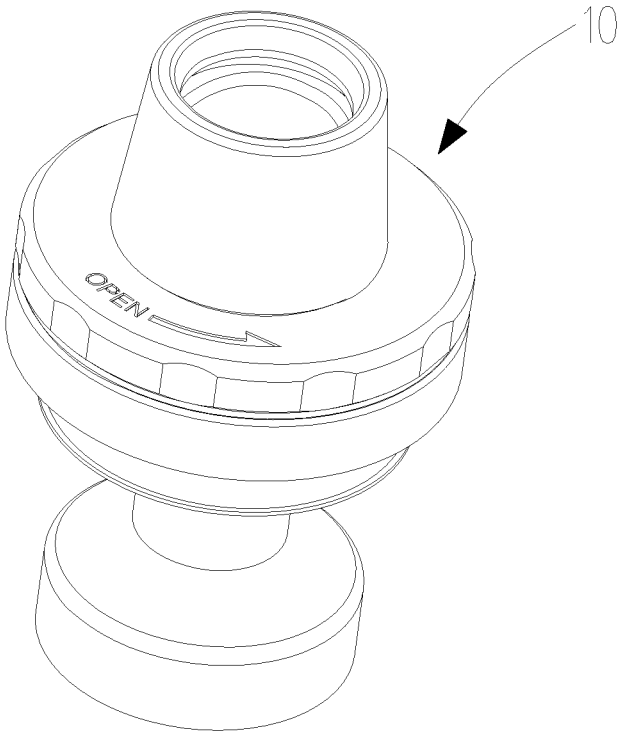
FIG. 3 is a schematic view of an upper cover assembly in FIG. 1.
Figure 4:
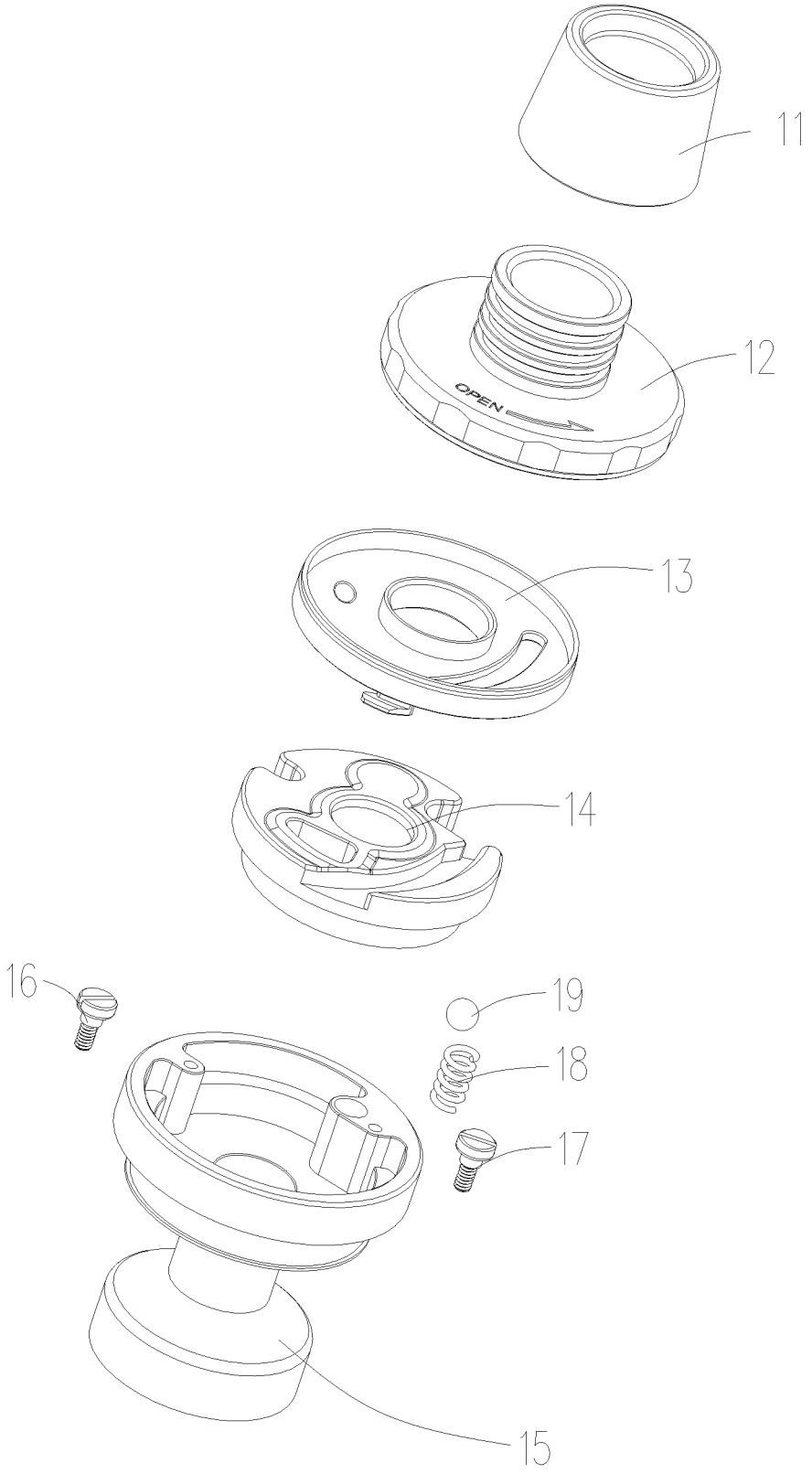
FIG. 4 is an exploded view of the upper cover assembly of FIG. 3.

As shown in FIG. 3 and FIG. 4, the upper cover assembly 10 includes a mouth piece 11, an upper cover 12, an inner lining member 13 and a connecting member 15. The mouth piece 11 is detachably connected to the upper cover 12. The upper cover 12 is connected to an upper end of the inner lining member 13. The inner lining member 13 is rotatably connected to the connecting member 15.

Both the mouth piece 11 and the upper cover 12 substantially have a cylindrically structure with two opening ends, the upper cover 12 is in communication with the mouth piece 11, the mouth piece 11 is sleeved on the outside of the upper cover 12.

Figure 5:
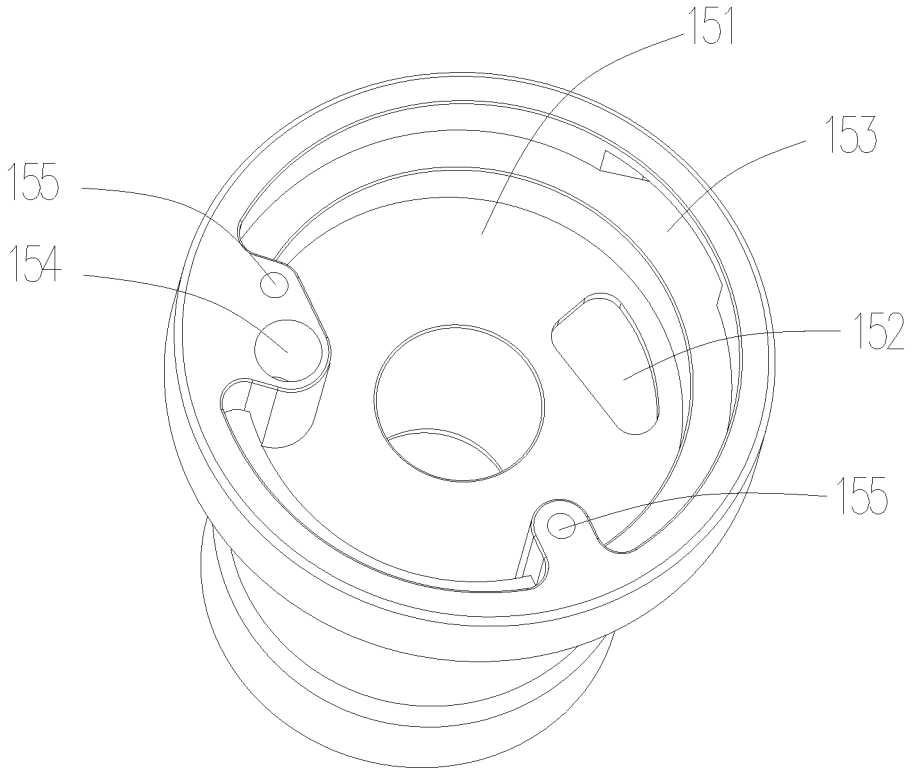
FIG. 5 is a schematic view of a connecting member in FIG. 4.

Referring to FIGS. 5 and 15, the connecting member 15 substantially has a cylindrical structure with two opening ends, the lower end of the connecting member 15 is connected to the atomizer head 50, a liquid storage chamber 40 is formed between the connecting member 15 and the sleeve 20, the upper end surface of the connecting member 15 defines a receiving portion 151. A sealing member 14 having a shape matching the receiving portion 151 is positioned in the receiving portion 151. The sealing member 14 can engage the connecting member 15 via an interference engagement, the receiving portion 151 defines a first liquid intake hole 152 at the bottom, the first liquid intake hole 152 is in communication with the liquid storage chamber 40, the side wall of the receiving portion 151 defines a latching groove 153, a rotatable shaft 16 and a limiting shaft 17 are positioned on the upper end surface of the connecting member 15, the upper end surface of the connecting member 15 further defines an assembly hole 154, the assembly hole 154 is provided with an elastic member 18 therein, a limiting member 19 is fixed to an upper end of the elastic member 18, a part of the limiting member 19 is exposed outside the assembly hole 154. In the illustrated embodiment, the limiting member 19 can be spherical body, such as a roll ball, facilitating for the limiting member 19 to perform a movement in the assembly hole 154 with a minor friction force. In the illustrated embodiment, both the rotatable shaft 16 and the limiting shaft 17 are screws, the connecting member 15 defines a threaded hole 155 corresponding to the rotatable shaft 16 and the limiting shaft 17.

Figure 6:
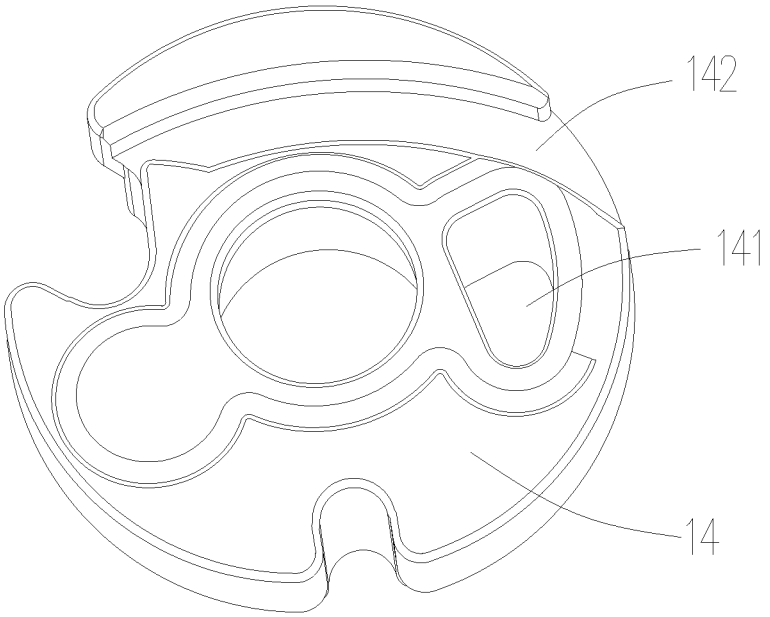
FIG. 6 is a schematic view of a sealing member in FIG. 4.

Referring to FIG. 6, the sealing member 14 defines a second liquid intake hole 141 corresponding to the first liquid intake hole 152, the upper surface of the sealing member 14 defines a second sliding groove 142, the second sliding groove 142 cuts through a peripheral surface of the sealing member 14. An end of the second sliding groove 142 is in communication with the latching groove 153. In one embodiment, the sealing member 14 is made of silica material.

Figure 7:
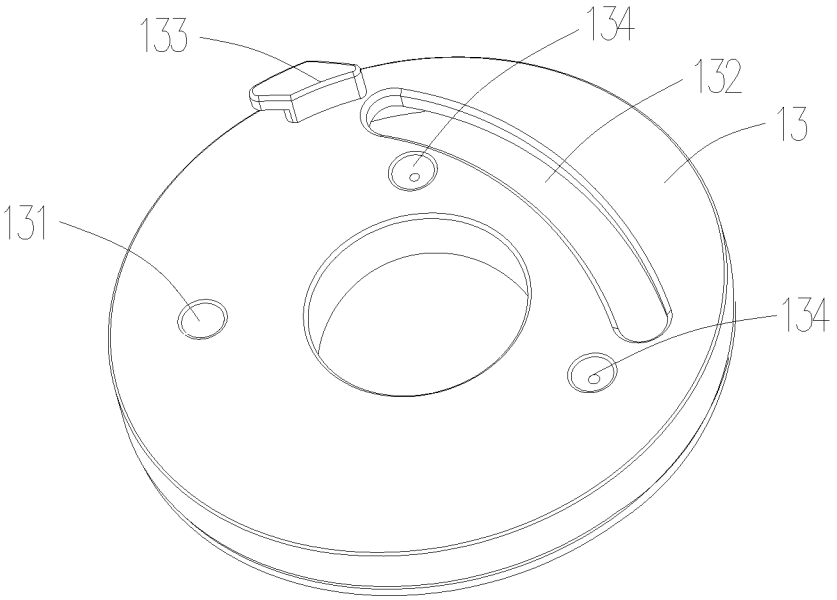
FIG. 7 is a schematic view of an inner lining member in FIG. 4.
Figure 8:
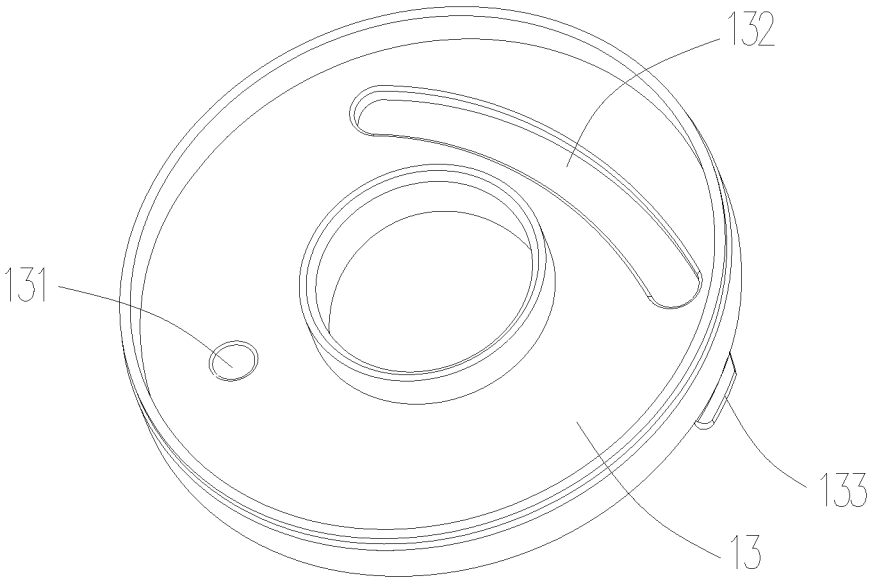
FIG. 8 is a schematic view of the inner lining member in FIG. 4, viewed from another aspect.

Referring to FIG. 7 and FIG. 8, the inner lining member 13 substantially has a cylindrical structure with two opening ends, the inner lining member 13 defines a positioning hole 131 corresponding to the rotatable shaft 16, and a first sliding groove 132 corresponding to the limiting shaft 17. Both the positioning hole 131 and the first sliding groove 132 cut through opposite end surfaces of the inner lining member 13 along an axial direction of the inner lining member 13, the inner lining member 13 is rotatably connected to the rotatable shaft 16, the limiting shaft 17 can slide relative to the first sliding groove 132, the lower end surface of the inner lining member 13 defines two matching grooves 134, the positions of the two matching grooves 134 are corresponding to the positions of the elastic member 18 respectively, when the first liquid intake hole 152 is opened or closed, an edge of the lower end surface of the inner lining member 13 is provided with a latching clip 133, the latching clip 133 can slide relative to the second sliding groove 142 and enters the latching groove 153 positioned on an end of the second sliding groove 142, thereby locking the inner lining member 13 to the connecting member 15.

Figure 9:
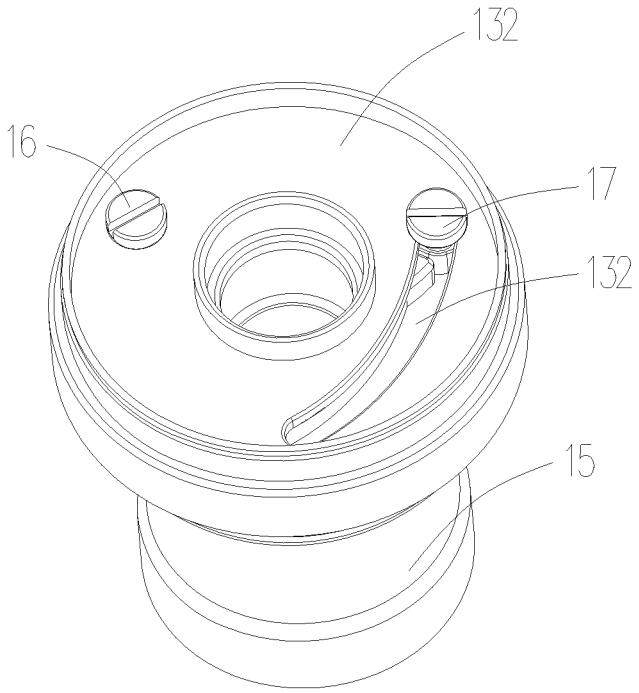
FIG. 9 is a schematic view showing a connection between the inner lining member and the connecting member, when the atomizer is in a working state.
Figure 10:
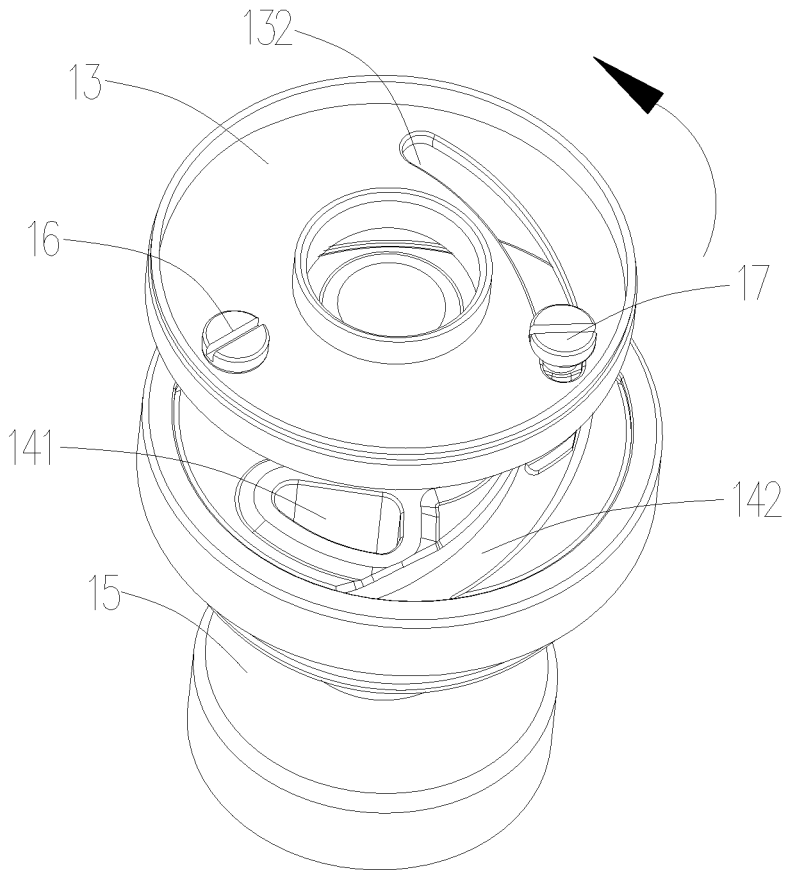
FIG. 10 is a schematic view showing a connection between the inner lining member and the connecting member, when the atomizer is in a liquid injection state.

Referring to FIG. 9 and FIG. 10, when a liquid injection is performed, the upper cover 12 is rotated to enable the upper cover 12 and the inner lining member 13 to rotate relative to the connecting member 15 around a center of the rotatable shaft 16, the latching clip 133 slides from the latching groove 153 to the second sliding groove 142, thereby unlocking the inner lining member 13 and the connecting member 15. During the rotation process of the inner lining member 13, the elastic member 18 is compressed by the inner lining member 13, thus a hand feeling is improved. The limiting shaft 17 slides relative to the first sliding groove 132, and at the same time, the latching clip 133 slides in the second sliding groove 142. When the first liquid intake hole 152 and the second liquid intake hole 141 are opened completely, the elastic member 18 is positioned in one matching groove 134, the inner lining member 13 shielding the second liquid intake hole 141 after a random rotation of the inner lining member 13 is prevented, thereby the liquid injection cannot be influenced, at the time, it is convenient to perform a liquid injection. Because the limiting member 19 falls in one matching groove 134, thus a vibration and a sound can happen, reminding user that it reaches the right place. In the illustrated embodiment, the elastic member 18 can be members having elasticity recovering function, such as a spring or a rubber stopper.

When the liquid injection is finished, the upper cover 12 is rotated along a reversed direction, enabling the latching clip 133 to enter the latching groove 153 by passing through the second sliding groove 142, the latching clip 133 locks the inner lining member 13 and the connecting member 15, the elastic member 18 enters the other matching groove 134.

In the atomizer 100, the upper cover 12 slides along a side, enabling the second liquid intake hole 141 to be revealed for performing a liquid injection, causing the liquid injection operation to be more convenient and easier, the rotatable inner lining member 13 is positioned on the inner of the upper cover assembly 10, ensuring an integrity of the outer structure of the product.

The Second Embodiment

The main differences between the second embodiment and the first embodiment are that: the first sliding groove 132 of the second embodiment has a shape different from that of the first embodiment, the position hole 131 of the second embodiment has a shape different from that of the first embodiment. At the same time, in the illustrated embodiment, the connecting member 15 does not have the assembly hole 154, the elastic member 18 and the elastic member 19 are omitted, the lower end surface of the inner lining member 13 does not have the matching groove 134.

Figure 11:
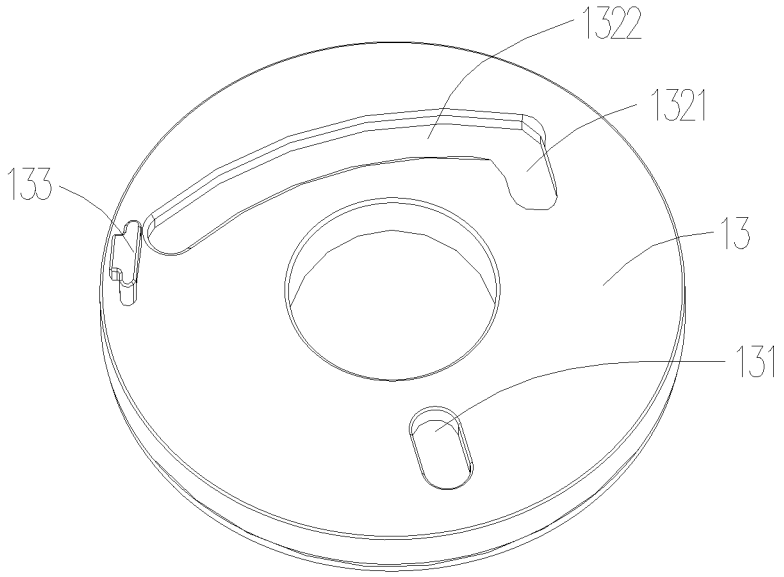
FIG. 11 is a schematic view of an inner lining member according to a second embodiment.

Referring to FIG. 11, the position hole 131 is a kidney hole.

The first sliding groove 132 substantially has a "L" shape and includes a translational groove 1321 and a rotation groove 1322 in communication with the translational groove 1321, the positioning hole 131 is parallel to the translational groove 1321.

Figure 12:
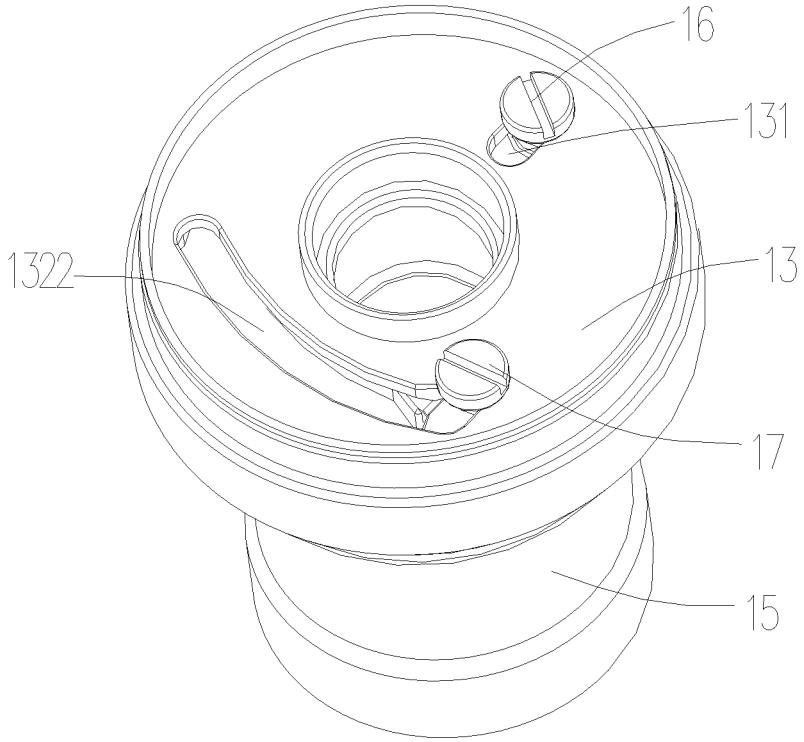
FIG. 12 is a schematic view showing a connection between the inner lining member and the connecting member, when the atomizer according to the second embodiment is in a working state.

Referring to FIG. 12, when the inner lining member 13 and the connecting member 15 are locked, the latching clip 133 is positioned in the latching groove 153 of the connecting member 15, the rotatable shaft 16 is positioned on an end of the positioning hole 131 away from the rotation groove 1322, the limiting shaft 17 is positioned on an end of the rotation groove 1322 away from the translational groove 1321.

Figure 13:
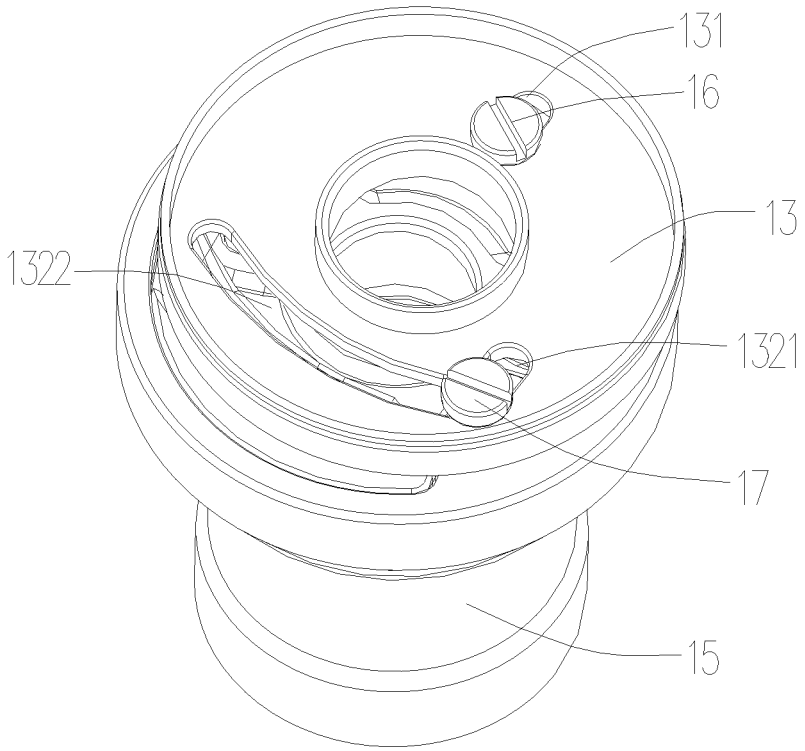
FIG. 13 is a schematic view showing a connection between the inner lining member and the connecting member, when the inner lining member of the atomizer according to the second embodiment is in a rotating process.
Figure 14:
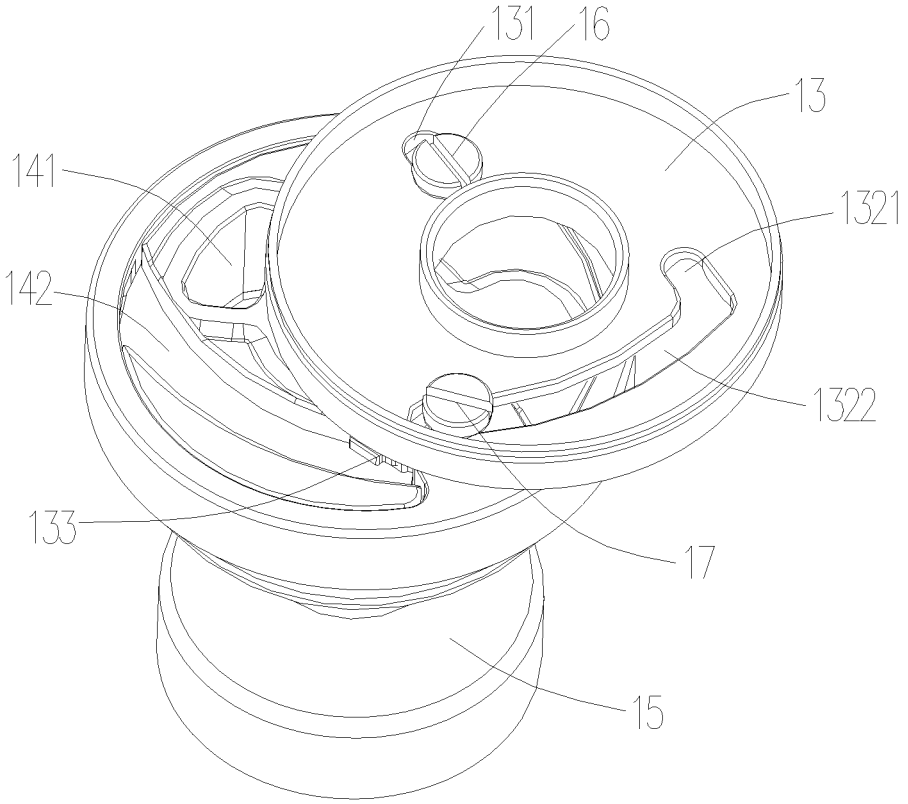
FIG. 14 is a schematic view showing a connection between the inner lining member and the connecting member, when the atomizer according to the second embodiment is in the liquid injection state.

Referring to FIG. 12 and FIG. 13, when a liquid injection is required, a translational movement of the upper cover 12 is conducted, the latching clip 133 enters the second sliding groove 142 from the latching groove 153, thereby enabling the inner lining member 13 and the connecting member 15 to be unlocked, the rotatable shaft 16 is moved from one end of the positioning hole 131 to an opposite end of the positioning hole 131, the limiting shaft 17 is moved from the translational groove 1321 to the rotation groove 1322. Referring to FIG. 14 again, the upper cover 12 is then rotated, the inner lining member 13 is rotated around an axis of the rotatable shaft 16, the latching clip 133 is rotated in the second sliding groove 142, the limiting shaft 17 is rotated relative to the rotation groove 1322 until the limiting shaft 17 reaches the end of the rotation groove 1322 away from the translational groove 1321, causing the second liquid intake hole 141 to be revealed to perform a liquid injection.

After the liquid injection is finished, the upper cover 12 is rotated along a reversed direction, enabling the latching clip 133 to slide along the second sliding groove 142, the limiting shaft 17 is moved to the translational groove 1321, and a translational movement of the upper cover 12 is conducted, enabling the latching clip 133 to enter the latching groove 153, thereby by locking the inner lining member 13 and the connecting member 15.

In the atomizer 100, a translational movement of the upper cover 12 is performed, and the upper cover 12 slides along a side, enabling the second liquid intake hole 141 to be revealed for performing a liquid injection, the liquid injection operation is simplified, a translational push operation is added prior to the side sliding movement, the liquid injection hole cannot be opened easily by children, a children protection function is added.

The embodiments described above are merely preferred embodiments, but not intended to limit the application. Any modifications, alternatives or improvements made within the principle and spirit of the present application should be interpreted as falling within the protection scope of the present application. The claims are not limited to the features or acts described above. Rather, the proper scope of the disclosure is defined by the appended claims.

What is claimed is:

1. An atomizer, having a liquid storage chamber, comprising:

an upper cover assembly, comprising:

an inner lining member defining a positioning hole and a first sliding groove, the first sliding groove comprising a translational groove and a rotation groove in communication with the translational groove, the positioning hole being parallel to the translational groove, and a connecting member defining a first liquid intake hole in communication with the liquid storage chamber, the connecting member being provided with a rotatable shaft mounted in the positioning hole and a limiting shaft mounted in a first limiting groove;

a base assembly; and an atomizer head, wherein the inner lining member or the connecting member is pushed until the limiting shaft reaches the rotation groove from the translational groove, the inner lining member and the connecting member rotate around the rotatable shaft, the limiting shaft slides along the rotation groove to reveal the first liquid intake hole.

2. The atomizer according to claim 1, wherein the positioning hole is a kidney hole, the first sliding groove is a "L" shape groove.

3. The atomizer according to claim 1, wherein the connecting member defines a latching groove, the inner lining member is provided with a latching clip corresponding to the latching groove, or, the connecting member is provided with a latching clip, the inner lining member defines a latching groove corresponding to the latching clip, the latching clip is latched with the latching groove to enable the inner lining member to remain a closed state relative to the connecting member.

4. The atomizer according to claim 3, wherein the connecting member is provided with a sealing member therein, the sealing member defines a second liquid intake hole corresponding to the first liquid intake hole.

5. The atomizer according to claim 4, wherein the sealing member defines a second sliding groove for the latching clip passing through.

6. The atomizer according to claim 5, wherein the connecting member defines a sealing groove, the sealing member is hermetically positioned in the sealing groove.

7. The atomizer according to claim 1, wherein the connecting member is provided with an elastic member, an end of the elastic member is fixed to the connecting member, an opposite end of the elastic member is provided with a limiting member, the inner lining member defines a first matching groove and a second matching groove.

8. The atomizer according to claim 7, wherein the first matching groove is in a first position matching the limiting member when the first liquid intake hole is open and the second matching groove is in a second position matching the limiting member when the first liquid intake hole is closed.

9. The atomizer according to claim 7, wherein the connecting member defines an assembly hole, the elastic member is positioned in the assembly hole, a part of the limiting member is revealed in the assembly hole.

10. An electronic cigarette, comprising an atomizer according to claim 1.

11. An atomizer, having a liquid storage chamber, the atomizer comprising:

an upper cover assembly, comprising:

an inner lining member defining a first sliding groove;

a connecting member defining a first liquid intake hole in communication with the liquid storage chamber, the connecting member being provided with a rotatable shaft and a limiting shaft;

a base assembly; and an atomizer head, wherein the upper cover assembly and the base assembly are respectively mounted on opposite ends of the atomizer head, the limiting shaft extends through the first sliding groove, the inner lining member is rotatably connected to the rotatable shaft, when the inner lining member rotates relative to the connecting member, the limiting shaft slides in the first sliding groove to open or close the first liquid intake hole.

12. The atomizer according to claim 11, wherein the connecting member defines a latching groove, the inner lining member is provided with a latching clip corresponding to the latching groove, or, the connecting member is provided with a latching clip, the inner lining member defines a latching groove corresponding to the latching clip, the latching clip is latched with the latching groove to enable the inner lining member to remain a closed state relative to the connecting member.

13. The atomizer according to claim 12, wherein the connecting member is provided with a sealing member therein, the sealing member defines a second liquid intake hole corresponding to the first liquid intake hole.

14. The atomizer according to claim 13, wherein the sealing member defines a second sliding groove for the latching clip passing through.

15. The atomizer according to claim 13, wherein the connecting member defines a sealing groove, the sealing member is hermetically positioned in the sealing groove.

16. The atomizer according to claim 11, wherein the connecting member is provided with an elastic member, an end of the elastic member is fixed to the connecting member, an opposite end of the elastic member is provided with a limiting member, the inner lining member defines a first matching groove and a second matching groove.

17. The atomizer according to claim 16, wherein the first matching groove is in a first position matching the limiting member when the first liquid intake hole is open and the second matching groove is in a second position matching the limiting member when the first liquid intake hole is closed.

18. The atomizer according to claim 16, wherein the elastic member is a spring, the connecting member defines an assembly hole, the limiting member is a roll ball, the elastic member is positioned in the assembly hole, a part of the limiting member is revealed in the assembly hole.

19. The atomizer according to claim 11, wherein the upper cover assembly further comprises an upper cover positions on the inner lining member and wrapped around the inner lining member.

20. An electronic cigarette, comprising an atomizer according to claim 11.

* * * * *